US007367789B2

(12) United States Patent
Raghavan et al.

(10) Patent No.: US 7,367,789 B2
(45) Date of Patent: May 6, 2008

(54) DEVICE FOR MAINTAINING A STATIC SEAL OF A HIGH PRESSURE PUMP

(75) Inventors: Chidambaram Raghavan, Seattle, WA (US); Kraig T. Kostohris, Maple Valley, WA (US); Katherine M. Madden, Kent, WA (US); Shawn M. Callahan, Seattle, WA (US); Sigurd C. Mordre, Vashon Island, WA (US); Mohamed A. Hashish, Bellevue, WA (US); Olivier L. Tremoulet, Jr., Edmonds, WA (US)

(73) Assignee: Flow International Corporation, Kent, WA (US)

( * ) Notice: Subject to any disclaimer, the term of this patent is extended or adjusted under 35 U.S.C. 154(b) by 802 days.

(21) Appl. No.: 10/676,843

(22) Filed: Oct. 1, 2003

(65) Prior Publication Data

US 2005/0074350 A1 Apr. 7, 2005

(51) Int. Cl.
*F04B 39/10* (2006.01)
*F16J 10/04* (2006.01)

(52) U.S. Cl. ..... 417/571; 92/171.1

(58) Field of Classification Search ..... 92/171.1; 417/454, 569, 570, 571
See application file for complete search history.

(56) References Cited

U.S. PATENT DOCUMENTS

| | | | | | |
|---|---|---|---|---|---|
| 3,207,081 | A | * | 9/1965 | Bauer | 92/171.1 |
| 3,309,013 | A | | 3/1967 | Bauer | 230/231 |
| 3,370,545 | A | | 2/1968 | Waibel | 103/228 |
| 3,446,427 | A | * | 5/1969 | Konyaev et al. | 92/171.1 |
| 3,778,196 | A | * | 12/1973 | Vereschagin et al. | 92/171.1 |
| 4,432,386 | A | | 2/1984 | Pacht | 137/327 |
| 4,536,135 | A | | 8/1985 | Olsen et al. | 417/383 |
| 4,551,077 | A | | 11/1985 | Pacht | 417/454 |
| 4,593,858 | A | | 6/1986 | Pacht | 239/126 |
| 4,616,983 | A | * | 10/1986 | Hanafi | 417/571 |
| 4,878,815 | A | | 11/1989 | Stachowiak | 417/63 |
| 5,037,276 | A | | 8/1991 | Tremoulet, Jr. | 417/567 |
| 5,127,807 | A | | 7/1992 | Eslinger | 417/360 |
| 5,171,136 | A | | 12/1992 | Pacht | 417/571 |
| 5,302,087 | A | | 4/1994 | Pacht | 417/53 |
| 5,924,853 | A | | 7/1999 | Pacht | 417/567 |
| 6,092,370 | A | | 7/2000 | Tremoulet, Jr. et al. | 60/328 |

(Continued)

OTHER PUBLICATIONS

Flyer, Specifications for Model No. TF-375UH, Gardner Denver Water Jetting Systems, Inc., Houston, Texas, no date, two pages.

*Primary Examiner*—Michael Koczo, Jr.
(74) *Attorney, Agent, or Firm*—Seed Intellectual Property Law Group PLLC

(57) ABSTRACT

A pressure enclosure includes a first component having an opening, a second component coupled to the first component in a position over the opening, a third component positioned between the first and second components and covering the opening, and a load chamber defined by a space between the second and third components and configured such that pressure in the load chamber biases the third component against the first component to seal the opening. The pressure enclosure may be a cylinder of a pump for pressurizing fluid or gas, with the first component a cylinder body, the second component an end cap and the third component a valve body, with the load chamber biasing the valve body against the cylinder body.

36 Claims, 11 Drawing Sheets

U.S. PATENT DOCUMENTS 6,241,492 B1 6/2001 Pacht ..... 417/567
2003/0122376 A1 7/2003 Hopkins et al. ..... 285/334.1
2005/0249615 A1* 11/2005 Jezek ..... 417/571

* cited by examiner

DEVICE FOR MAINTAINING A STATIC SEAL OF A HIGH PRESSURE PUMP

BACKGROUND OF THE INVENTION

1. Field of the Invention

The present invention relates to the field of high pressure enclosures, and maintaining a seal on such an enclosure.

2. Description of the Related Art

High-pressure fluid pumps are used in various industrial applications. For example, a high-pressure pump may be used to provide a pressure stream of water for cleaning and surface preparation of a wide variety of objects, from machine parts to ship hulls.

High-pressure pumps may also be used to provide a stream of pressurized water for water jet cutting. In such an application, a pump pressurizes a stream of water, which flows through an orifice to form a high-pressure fluid jet. If desired, the fluid stream may be mixed with abrasive particles to form an abrasive water jet, which is then forced through a nozzle against a surface of material to be cut. Such cutting systems are commonly used to cut a wide variety of materials, including glass, ceramic, stone and various metals, such as brass, aluminum, and stainless steel, to name a few. A single pump may be used to provide pressurized fluid to one or several tools.

In another application, high-pressure fluid pumps are used for isostatic pressurization, used in many industrial applications, including processing of foods, manufacture of machine parts, and densification of various components and materials.

A detailed description of the operation of a high-pressure pump may be found in U.S. Pat. No. 6,092,370, issued on Jul. 25, 2000, in the name of Tremoulet, Jr. et al., which patent is incorporated herein by reference in its entirety.

FIG. 1 illustrates a simplified cut away of a pump head of a typical high-pressure fluid pump. The fluid pump 100 includes a cylinder 102 and plunger 104. A valve body 114 is located at the end of the cylinder 102, and incorporates inlet and outlet check valves (not shown in detail). The valve body 114 is held in place against the cylinder by an end cap 106. Tie rods 108 pass through apertures in the end cap 106 to engage the pump body (not shown). Torque nuts 110 and thrust washers 112 engage upper ends of the tie rods 108 to draw the end cap 106 tightly against the cylinder 102, capturing the valve body 114 therebetween. A plunger or piston 104 is positioned within the cylinder to pressurize fluid in the cylinder.

An annular seal or gasket 116 is positioned between the valve body 114 and the end of the cylinder 102 to create a static seal configured to prevent fluid from passing between the valve body 114 and the cylinder 102. The gasket 116 may be made from a polymeric material or from another material that is softer than the materials used to make the valve body 114 and the cylinder 102, even including a metal gasket.

Another type of static seal, in which the valve body is biased directly against the cylinder, is described in U.S. patent application Ser. No. 10/038,507, entitled "Components, Systems and Methods for Forming a Gasketless Seal Between Like Metal Components in an Ultrahigh Pressure System," which is assigned to Flow International Corporation and is incorporated herein by reference in its entirety.

Fluid pumps of the type described herein are used to generate fluid pressures of between 30,000 and 100,000 psi. Because of the very high pressure generated within the cylinder 102 during a pressurizing stroke of the plunger 104, one of the most common problems in pumps of this type is failure of the static seal 116. In such a failure, fluid is forced between the valve body 114 and the cylinder walls 102, to escape the pump. Such a failure results in a reduction in the overall pressure generated by the pump 100, and damage to the pump itself, as fluid, passing at high pressures through unintended pathways, causes fatigue and erosion.

A very high degree of force, pressing the valve body 114 against the cylinder 102, is required to reduce the occurrence of such failures of the static seal 116. In a pump of the type illustrated in FIG. 1, this force is achieved by extremely high torque on the tie rod nuts 110 on each of four tie rods 108. To achieve the necessary force, torque in the range of 700 foot-pounds on each of the tie rod nuts 110 may be required. However, torque at this high level creates several significant complications, apart from the high degree of effort required to install and remove the nuts 110. First, as torque is applied to a tie rod nut 110, friction between the nut and the tie rod 108 places rotational stress on the tie rod 108. As torque on the tie rod nut 110 increases, rotational force on the tie rod 108, caused by friction, begins to twist the tie rod 108. When the appropriate torque is achieved on the tie rod nut 110, and the torquing force is removed, the tie rod 108 exerts a reverse rotational force on the tie rod nut 110 and the thrust washer 112. This same reverse rotational force is exerted by each of the tie rods 108 on each of the tie rod nuts 110 and thrust washers 112. As a result, a general rotational load is placed on the end cap 106. Part of this rotational load is transferred from the end cap 106 to the cylinder 102, placing undesirable forces on the pump 100, and even causing the end cap 106 and cylinder 102 to twist one or two degrees.

Additionally, at high torque loads, such as those discussed above, a large part of the total force generated by the high degree of torque placed on the tie rod nut 110 is expended in overcoming friction between the nut 110, the washer 112, and the tie rod 108. This part of the total force generated is lost to friction, and is not ultimately expressed as additional tensile load on the tie rod 108. As torque on the tie rod nut 110 increases, the total percentage of force lost to friction rises in a nonlinear fashion. Worse, this rise is unpredictable, very difficult to measure, and may vary, at the high torque loads required, by as much as 40% from one tie rod 108 to another. As a result, the four tie rods 108 of a pump cylinder 102, each having a tie rod nut 110 set at 700 foot-pounds of torque, may have vastly different tensile loads. These different loads can cause the end cap 106 to tilt, or to press with more force on one side of the cylinder 102 than the other, again causing accelerated failure of the static seal 116.

One solution to the problems caused by high torque on the tie rod nuts 110 is the use of super nuts as illustrated in FIG. 2, which shows a portion of an end cap 106 where a tie rod 108 protrudes. The super nut 130 is threaded onto the tie rod 108, and tightened to a much lower torque load of between 20 and 50 foot-pounds of torque. The super nut 130 includes a plurality of apertures into which jack bolts 132 are threaded. Each super nut has between 12 and 16 jack bolts. The jack bolts 132 pass through the super nut 130 to make contact with the thrust washer 112. Each jack bolt 132 presses against the thrust washer 112, pulling up on the super nut 130 and the tie rod 108. While each jack bolt 132 is applied with a modest degree of torque, the total force exerted by the jack bolts 132 of each of the four super nuts 130 is sufficient to maintain the necessary pressure on the end cap 106. Because the torque on each of the jack bolts is much lower, the percentage of the force generated lost to friction is also much lower. Additionally, because each super nut 130 has as many as 16 jack bolts, variations in force lost to friction by each jack bolt 130 will average out, resulting in a generally equal force on each tie rod 108.

There are, however, drawbacks to the use of super nuts 130. One drawback is the additional time required for installation or removal of the super nuts 130. When installing or removing the super nuts 130, torque on each of the jack bolts 132 must be applied or released gradually and cyclically, meaning that each of the jack bolts 132 on each of the super nuts 130 must be loosened or tightened by a very small amount, in turn, and repeatedly, until all of the bolts 132 of all the super nuts 130 have been fully loosened or fully tightened. This process is very time consuming, and can add two or more hours to the time required for removal and replacement of the end cap during servicing. Additionally, super nuts 130 and jack bolts 132 are subject to wear and fatigue, such that over time and repeated removal and re-installation, changes will occur in their response to tensile load and friction. As a result, combining new parts with old parts on a single pump head can result in uneven load conditions, again resulting in accelerated wear on the pump itself.

A second solution to the problems associated with high torque on the tie rod nuts 110 is described with reference to FIG. 3, and in more detail in U.S. Pat. No. 5,037,276, issued to Tremoulet, Jr. FIG. 3 illustrates a portion of a pump 134 having an output chamber 137 located between the valve body 114 and the end cap 106. An outlet port 162 admits pressurized fluid from the cylinder 102 to the outlet chamber 137 at the end of a pressurizing stroke of the piston 104, pressurizing the output chamber 137. Pressurized fluid exits the output chamber 137 via an output line 133, after which the fluid is channeled to an output manifold, or directly to an output tool. Meanwhile, the output chamber 137 remains pressurized at, or near, the maximum pressure achieved in the cylinder 102.

The end cap 106 applies downward pressure on the valve body 114, pressing the valve body against the cylinder 102, with static seal 116 therebetween. When the pump 134 begins operation, the output chamber 137 is charged to a pressure approaching that of the pressure within the cylinder 102. The pressurized fluid within the output chamber 137 exerts an upward force on the end cap 106, which loads the tie rods. Meanwhile, downward force on an upper surface 136 of the valve body 114 is equal to, or greater than, upward force on the lower surface 135 of the valve body, thus providing sufficient force to maintain the static seal 116.

One drawback to this solution is the need for an additional static seal 117, which must also withstand the high pressure generated within the cylinder 102. A more serious problem, however, is the fact that the tie rods 108 are unloaded every time the pump is turned off and the pressure within the output chamber is allowed to bleed away. This situation creates excessive stress on the tie rods, as they are repeatedly loaded and unloaded each time the pump 134 is turned on and off.

Another solution is proposed in U.S. Pat. No. 5,302,087, issued to Pacht, and described with reference to FIG. 4. A pump 210 includes a pressure housing 212, located between the end cap 106, and the valve body 114. The pressure housing comprises a liquid pressure chamber 214, with a pressure transmitting piston 216 located therein. Pressure from the outlet port 162 is transmitted to the liquid pressure chamber 214 via a flow line 136, a control valve 140, an additional flow line 138, and a flow path 142, which delivers pressurized fluid to the liquid pressure chamber 214.

When the pump 210 begins operation, the control valve 140 is opened, permitting pressurized fluid to pass through the control valve along the flow lines 136, 138, to the liquid pressure chamber 214, pressurizing the chamber 214 to a pressure approximately equal to the pressure produced within the cylinder 102. The pressure transmitting piston 216 is pressed upward against the end cap 106, loading the tie rods 108 and exerting pressure on the static seals 116. Once the liquid pressure chamber 214 is pressurized, the control valve 140 is closed, trapping the pressure within the pressure chamber 214. In this way, the tie rods remain loaded, even during periods when the pump 210 is not in operation.

Nevertheless, this solution is not without drawbacks. For example, the external compression lines 136, 138 are subject to failure due to the high pressure produced by the pump 210. Additionally, seals within the liquid pressure chamber 214 must withstand the high pressure produced by the pump 210.

BRIEF SUMMARY OF THE INVENTION

An embodiment of the invention provides a pressure enclosure, including a pressure body having an opening, a first member coupled to the pressure body in a position over the opening, a second member positioned between the pressure body and the first member and covering the opening, and a load chamber defined by a space between the first and second members. The load chamber is configured such that pressure in the load chamber acting on respective surfaces of the first and second members biases the second member against the pressure body over the opening, thereby maintaining a seal between pressure body and the second member.

The load chamber may be further configured to remain pressurized independent of the pressure in the pressure body. The load chamber may also be configured such that a pressure in the load chamber of less than the pressure in the pressure body is sufficient to bias the second member against the pressure body to maintain the seal. According to one embodiment, the pressure in the load chamber may be less than around 75% of the pressure in the pressure body. According to other embodiments, the pressure in the load chamber may fall in a range of between 75% to less than around 10% of the pressure in the pressure body.

Another embodiment of the invention provides a pump having a cylinder with a first end in which a medium may be pressurized, a valve body positioned across the first end of the cylinder, an end cap coupled to the cylinder and positioned over the valve body such that the valve body is held in position against the cylinder, and a load chamber defined by a space between the valve body and the end cap. The portion of the valve body within the load chamber has a surface area greater than an area of a cross section of the bore of the cylinder, and the load chamber is configured such that a pressure in the load chamber biases the valve body against the cylinder and forms a static seal therebetween. For example, the portion of the valve body within the load chamber may have a projected surface area greater than around 130% of the area of a transverse cross section of the bore of the cylinder. Because the projected surface area of the valve body within the load chamber is greater than the cross sectional area of the bore, the pressure in the load chamber may be proportionately less than in the cylinder and still maintain the static seal.

Another embodiment of the invention provides a pump, including a first member having a cylindrical bore, a second member positioned across a first end of the bore, and a static seal positioned between the first and second members and configured to prevent passage of fluid from between the fist and second members. The pump further includes a third member positioned opposite the first member, relative to the second member, and a load chamber positioned between the second and third members. The load chamber is configured to exert a separating bias between the second and third members, thereby biasing the second member against the static seal. A passage for transmitting pressurized fluid from the bore to the load chamber includes a check valve configured to trap pressurized fluid within the load chamber. The check valve is internal to the pump.

The pump may also include a pressure transmitting member positioned within the load chamber and configured to apply biasing force on the second member in response to pressure in the load chamber.

DETAILED DESCRIPTION OF THE INVENTION

The devices pictured in the attached figures are simplified for clarity. It will be understood that many components not necessary for understanding of the invention have been omitted.

Figure 5:
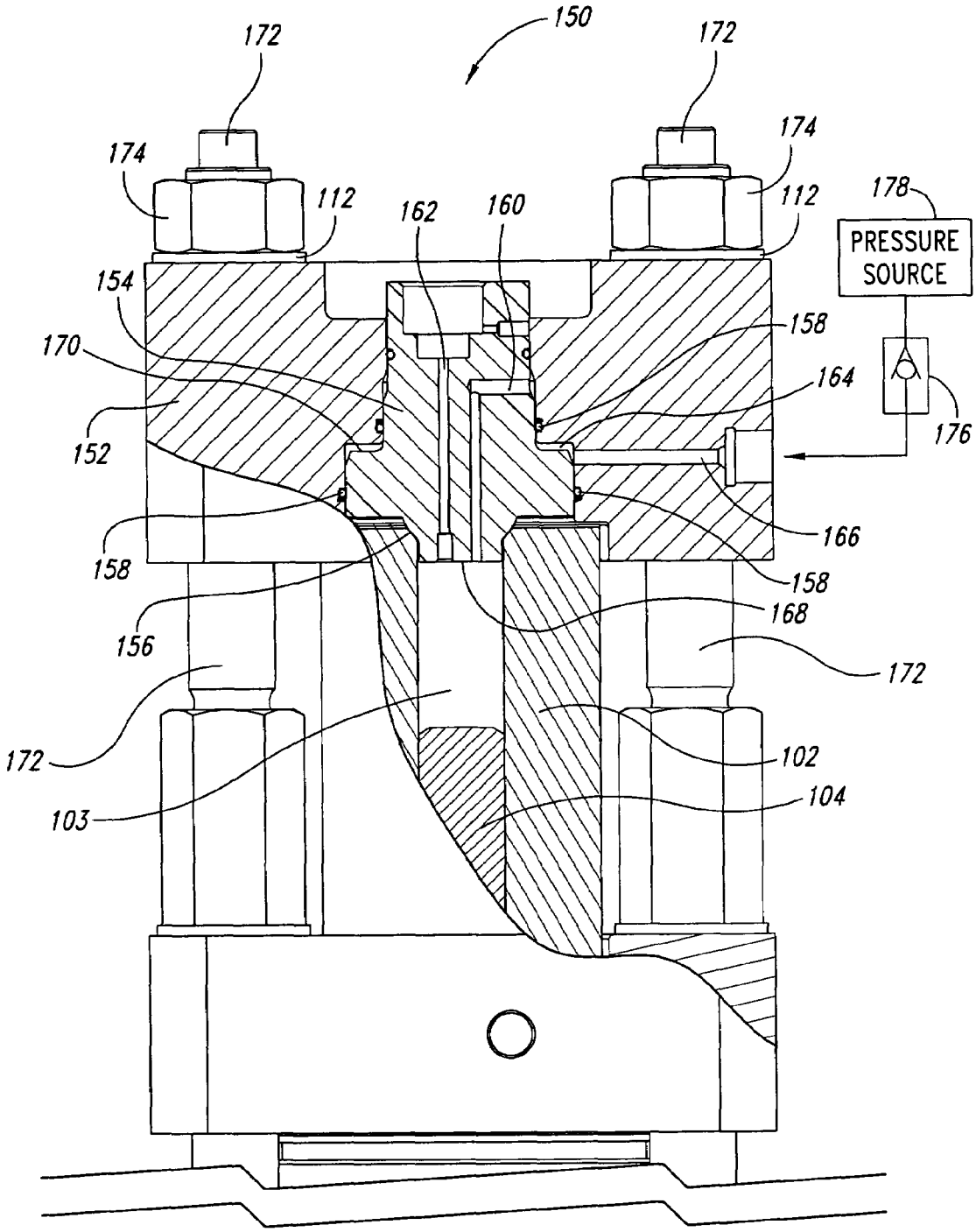
FIG. 5 is a cut-away view of a pump head according to an embodiment of the invention.

FIG. 5 illustrates a pump head 150 according to a first embodiment of the invention. The pump head 150 includes an end cap 152, a valve body 154, a pressure body, which in this case is a cylinder 102, and a plunger 104. Tie rods 172 receive tie rod nuts 174 and thrust washers 112 to apply force to the end cap 152, which in turn holds the valve body 154 in position against the cylinder 102. Static seal 156 is formed where the cylinder 102 meets the valve body 154. 0-rings 158 provide seals at various points between the valve body 154 and the end cap 152. During an intake stroke of the plunger 104, fluid enters the cylinder 102 via the inlet port 160. Pressurized fluid exits the cylinder 102 via the outlet port 162 during the pressurizing stroke of the plunger 104 (inlet and outlet check valves configured to control the flow of fluid entering and exiting the cylinder are not shown).

While the pump head of FIG. 5 comprises a static seal of the type disclosed in the previously incorporated application Ser. No. 10/038,507 it will be understood that the principles of the invention may be applied to other types of pumps and pressure enclosures as well.

According the principles of the invention, a load chamber 164 is provided between the valve body 154 and the end cap 152. A load chamber inlet port 166 provides access to the load chamber 164. Tie rod nuts 174 are installed with a nominal torque of between 25 and 50 foot-pounds onto the tie rods 172. The load chamber 164 is pressurized to a selected operating pressure via the load chamber inlet 166. The load chamber 164 is bordered on the top by the end cap 152 and on the bottom by a shoulder 170 of the valve body 154. When the load chamber 164 is pressurized by a pressure source 178, the pressure pushes the end cap 152 upward against the thrust washers 112 and tie rod nuts 174, and presses downward on the shoulder 170 of the valve body 154 against the static seal 156.

Figure 1:
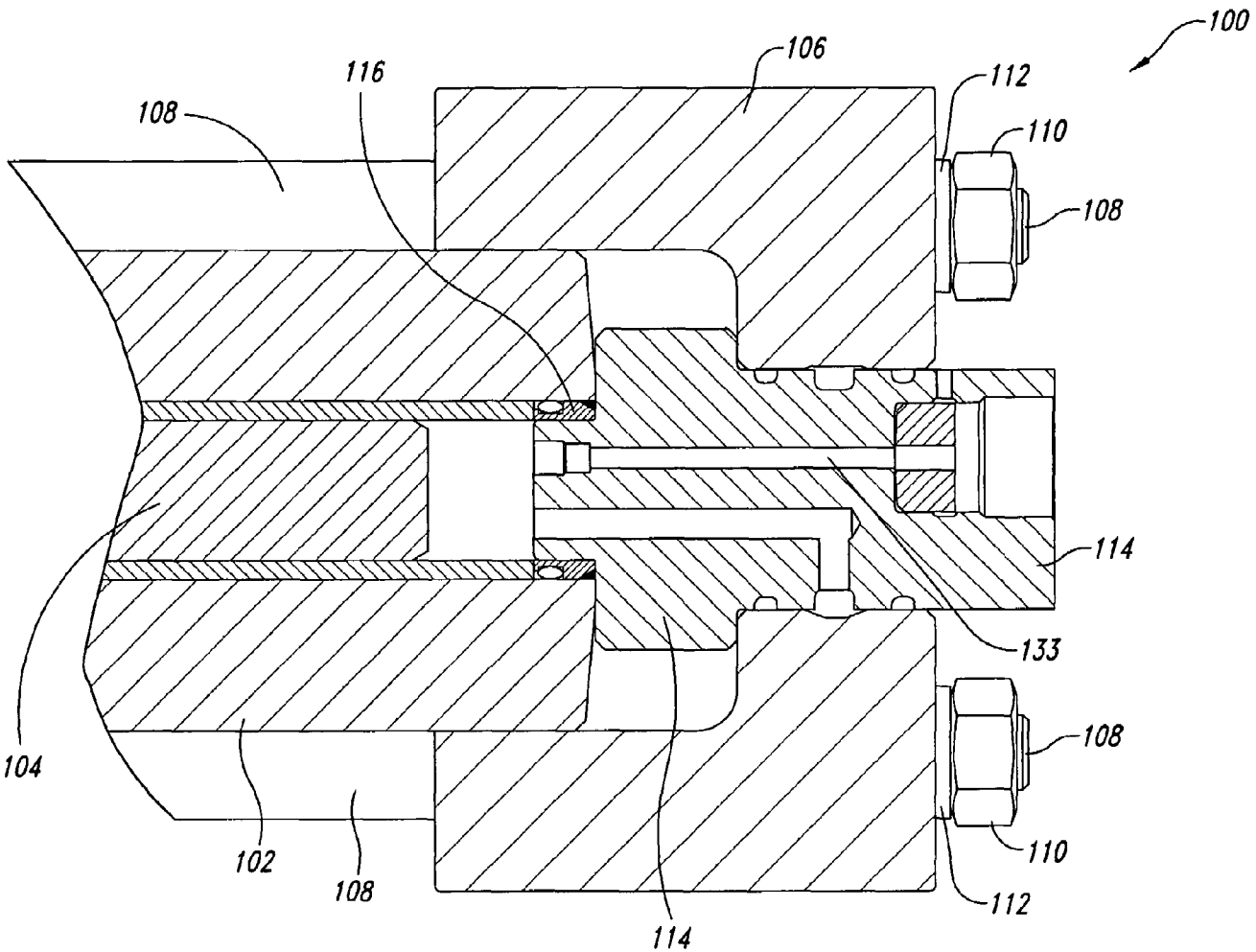
FIG. 1 (Prior Art)
FIG. 1 is a cutaway view of a pump head according to known art.
Figure 2:
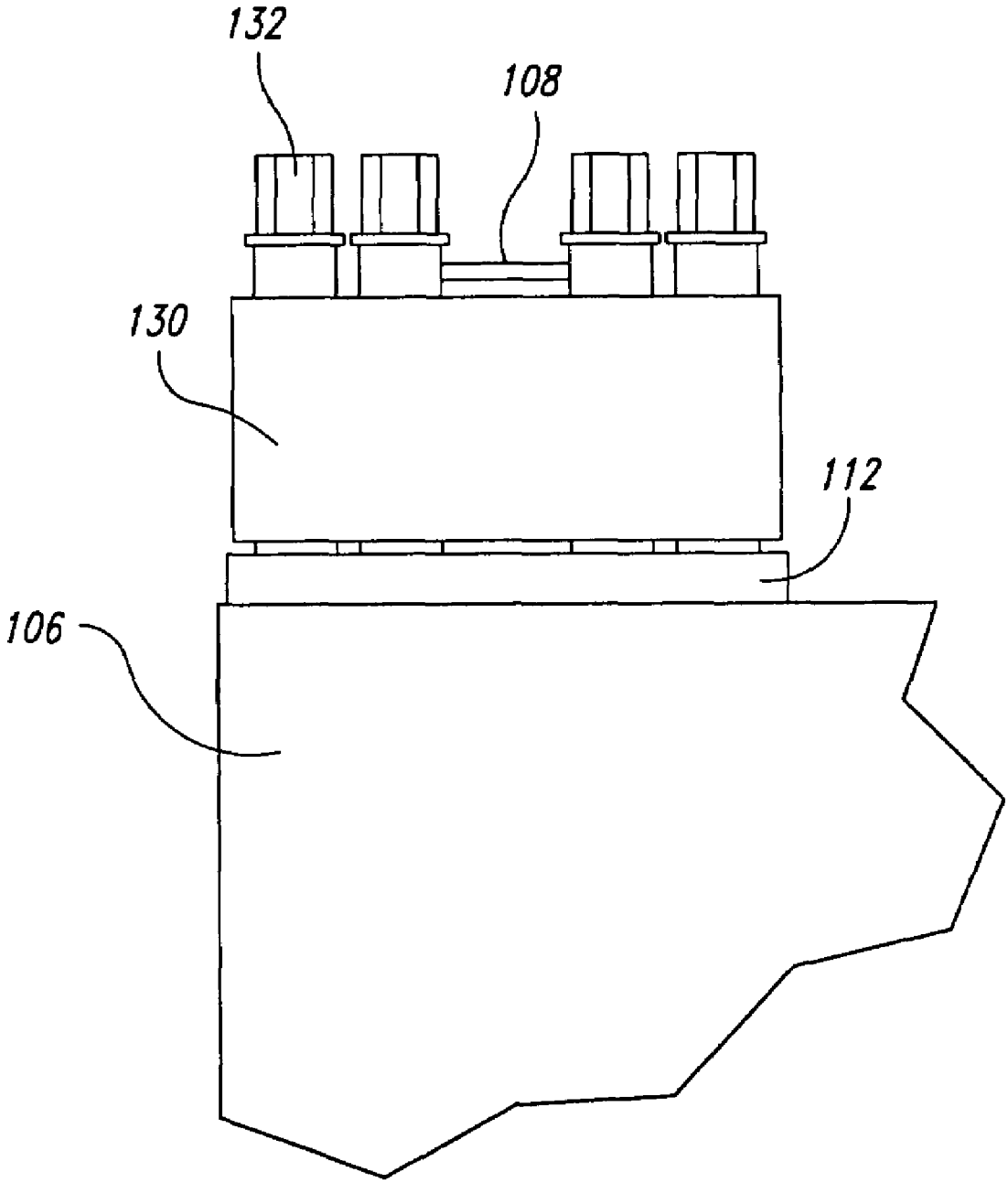
FIG. 2 (Prior Art)
FIG. 2 is a detail of a pump head according to known art.
Figure 3:
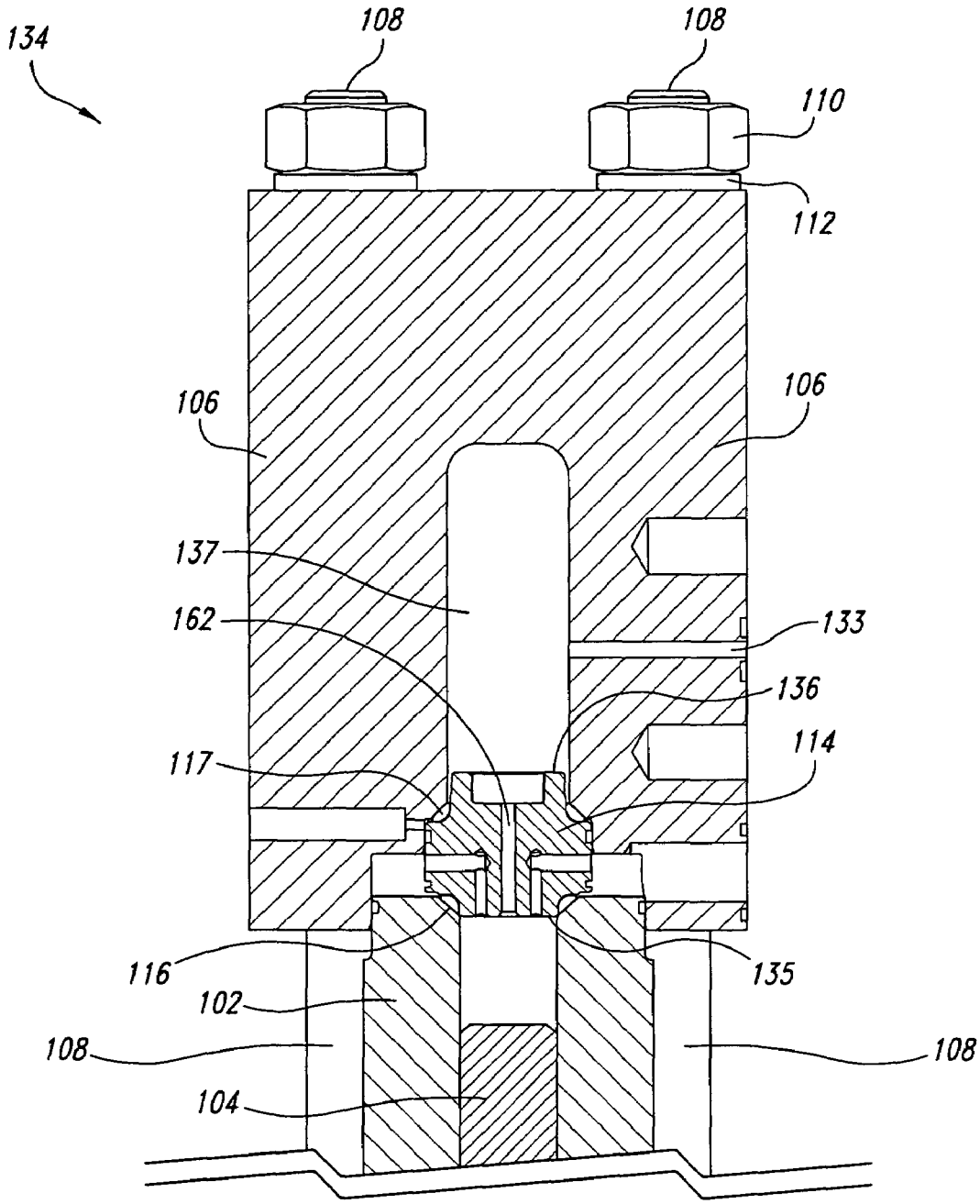
FIG. 3 (Prior Art)
FIGS. 3 and 4 show cutaway views of pump heads according to known art.
Figure 4:
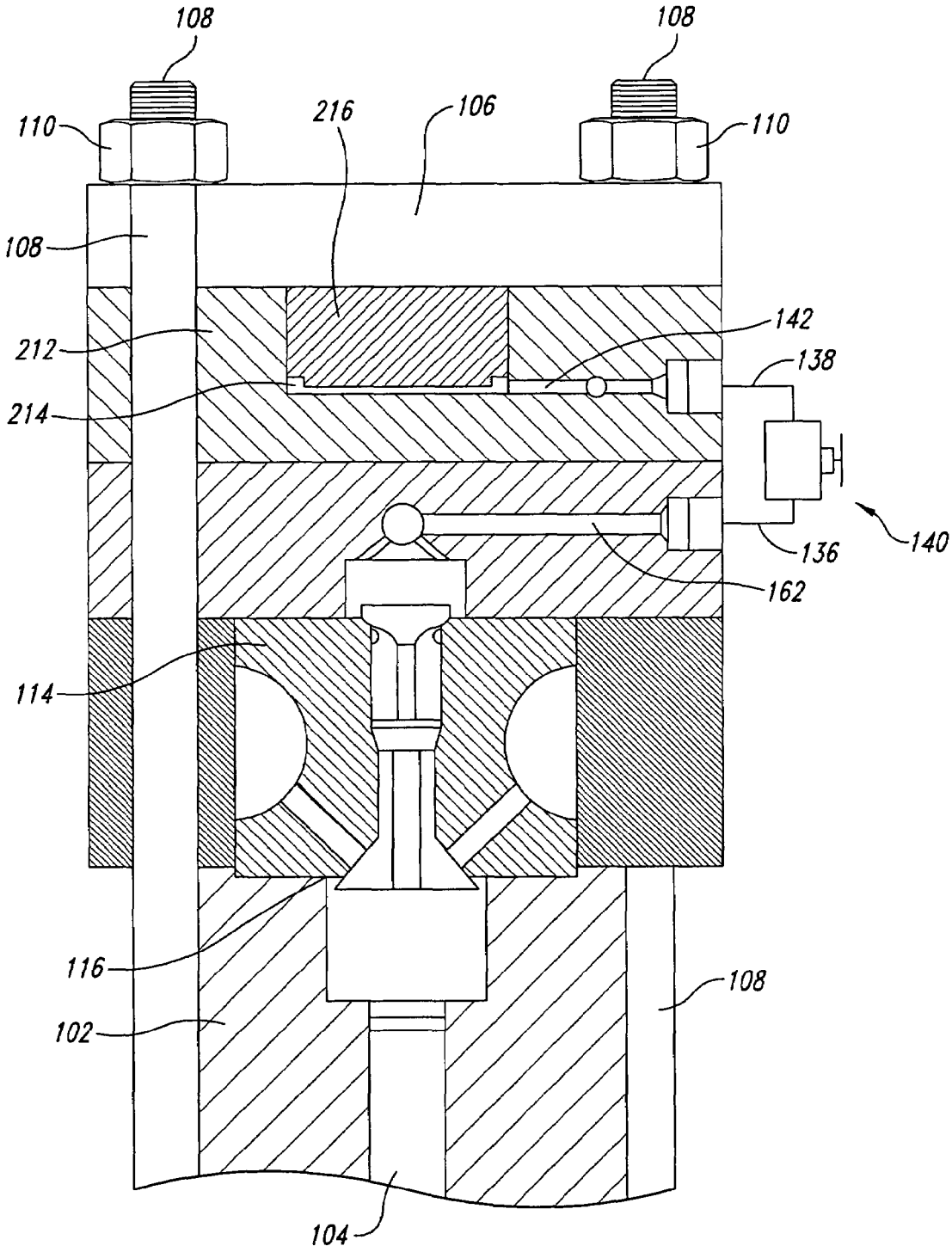
FIG. 4 (Prior Art)

During operation, as with the pump of FIG. 1, the pump of FIG. 5 generates enormous pressures within the cylinder 102 during the pressurizing stroke of the plunger 104. Pumps of this type may generate pressures approaching 100,000 psi. If the internal pressure of the cylinder, pressing upward against the bottom face 168 of the valve body 154, matches or exceeds a sum of forces pressing downward on the valve body 154 against the cylinder 102, fluid will escape the cylinder via the static seal 156.

In order for the static seal 156 to function properly, the downward force exerted on the valve body 154 must be greater than the upward force exerted on the bottom face 168 of the valve body 154. The upward force on the bottom face 168 may be calculated by the multiplying the maximum pressure achieved within the cylinder 102 by the total projected surface area of the bottom face 168 of the valve body 154.

The term projected surface area is used to describe the effective planar and normal area of a non-planar and non-normal surface. It will be recognized that the surface area of the bottom face of the valve body includes other structures attached thereto, upon which the pressure within the cylinder 102 will act. For example, the surfaces of inlet and outlet check-valves, not shown in the accompanying figures, may have any of a variety of shapes and profiles. In addition, the bottom surface 168 of the valve body 154 may not be normal, or perpendicular, with respect to an axis of the bore of the pump. Portions of the upper and lower surfaces may present an angled face relative to a plane that is normal to the axis of the bore, in such a case, a proportion of the force present at an angled face will be directed parallel to the axis of the bore. That proportion will be a function of the angle of the face relative to the axis of the bore. Where the angle of the surface is 90 degrees, with respect to the axis, the projected surface area and the actual surface area will be equal.

Where this specification makes reference to a surface area in the descriptions of the invention, or in the claims, it will be understood that this may be read as referring to a projected surface area.

Generally speaking, the area of a transverse cross section of the bore 103 of the cylinder 102 will be approximately equal to the total projected surface area of the bottom face of the valve body 154 on which the pressurized fluid acts.

The downward force exerted on the valve body 154 by the pressure of the load chamber 164 may be calculated by multiplying the pressure in the load chamber 164 by the surface area of the shoulder 170 of the valve body 154. Appropriate values for these parameters may be expressed in the following formula:

$$P_L A_L = P_C A_C M \qquad \text{Formula 1}$$

where $P_C$ is the maximum pressure in the cylinder, $A_C$ is the surface area of bottom face 168 of the valve body 154, $P_L$ is the operating pressure in the load chamber, $A_L$ is the surface area of the shoulder 170 of the valve body 154, and M is a selected margin of safety factor, which may be any value above unity.

It will be clear to those of ordinary skill in the art that the valve body 154 may be configured to have a surface area $A_L$ on the shoulder 170 that is much greater than the surface area of the bottom face 168 of the valve body 154, and to the degree that the surface $A_L$ of the shoulder 170 is greater than the surface area $A_C$ of the bottom face 168, the pressure $P_L$ of the load chamber 164 may be proportionately lower than the pressure $P_C$ of the cylinder 102. The minimum pressure $P_L$ of the load chamber 164 may be calculated using the following formula, derived from formula 1:

$$P_L = \frac{P_C A_C M}{A_L} \qquad \text{Formula 2}$$

Thus, for example, given a maximum cylinder pressure $P_C$ of 80,000 psi, an area $A_c$ of 1.5 square inches, an area $A_L$ of 10 square inches, and a margin M of 1.5, the minimum operating pressure $P_L$ of the load chamber may be calculated as follows:

$$\frac{(80K)(1.5)(1.5)}{10} = 18K \qquad \text{Formula 3}$$

Pascal's law teaches that any pressure in an enclosed space will be exerted equally on all surfaces of the space, so the same formulas used to calculate the downward force on the valve body 154 may be used to calculate the upward force on the end cap 152, the thrust washers 112, tie rod nuts 174, and, ultimately, the tensile load on the tie rods 172. It will therefore be understood that when the load chamber is appropriately pressurized, the tensile loads on the tie rods 172 of the pump head 150 will be approximately equal to the tensile loads needed on the tie rods 108 of the pump head 100 of FIG. 1 to ensure a good static seal.

While the load chamber 164 may be configured to function at the same pressure as that provided at the output 162 of the cylinder 102, it will be recognized that by configuring the load chamber 164 to function at pressures much lower than at the output 162, the seals 158, which maintain pressure in the load chamber 164, need not be configured to withstand the same high pressure as the static seal 156. According to one embodiment of the invention, the load chamber 164 is configured to function at a pressure $P_L$ significantly less than the cylinder pressure $P_C$. For example, $P_L$ may be less than around 75% $P_C$. According to a preferred embodiment of the invention, the load chamber 164 is configured to function at a pressure $P_L$ in a range of less than around 10%-20% of the cylinder pressure $P_C$.

The actual volume of the load chamber 164 need not be great. In fact, the volume of the load chamber 164 is exaggerated in FIG. 5 for clarity. In practice, the shoulder 170 of the valve body 154 may be very nearly in physical contact with the end cap 152. The principles expressed in Pascal's law function regardless of the volume of the space.

The advantages of the invention over prior methods of achieving the necessary loads are several. First, the tie rod nuts 110 may be installed at a relatively low torque. For example, a torque of around 25 ft-lbs may be adequate, which is a simple task when compared to the 700 ft-lbs of the prior method. The force exerted by the pressurized load chamber 164 on the valve body is independent of the exact distribution of tensile load exerted on the tie rods 172 by the torque nuts 174. Thus, unequal tensile loads on the tie rods are balanced, ensuring that the force of the valve body 154 is equally distributed on the static seal 156 and cylinder 102. Second, when the pressure in the load chamber is released, the torque required to remove the tie rod nuts 174 is the same nominal torque used to install them, resulting in significant reduction in time and effort needed to disassemble or reassemble the pump head 150. Third, because the load chamber 164 may be configured to exert sufficient downward force on the static seal 156 under pressures that are significantly lower than the output pressure of the pump 150, seals 158, configured to maintain pressure in the load chamber 164 are not required to operate at the same high pressures as the static seals 156. Additionally, again, because of the lower pressures required in the load chamber 164, supply and compression lines configured to supply pressure to the load chamber 164 need not be as robust.

It is desirable that the load chamber 164 remain pressurized even while the pump is not in operation, inasmuch as continuous cycling of pressure in the load chamber 164 may cause unnecessary fatigue to the pump components. Accordingly, a check valve 176 is shown schematically in FIG. 5 coupled between the pressure source 178 and the load chamber inlet 166. The check valve is configured to maintain pressure at an operating pressure of a selected level in the load chamber 164. When necessary, such as for servicing of the pump, pressure in the load chamber 164 may be easily released by loosening of a fitting to the load chamber inlet. Alternatively, the load chamber 164 may include a pressure release fitting (not shown). Check valves are well known in the art, and any of a wide variety of types may be used in this application.

In the embodiment shown in FIG. 5, the static seal 156 is illustrated as a metal-to-metal static seal. It will be recognized by those of ordinary skill in the art that the static seal 156 may be any of a variety of types of seals, and may incorporate gaskets, o-rings, bushings, resilient members, etc., and while the invention is described with reference to a static seal between the valve body 154 and the cylinder 102, the principles of the invention are also applicable to other seals and joints in pumps such as that pictured in FIG. 5, as well as in other devices having a pressurized enclosure.

Figure 6:
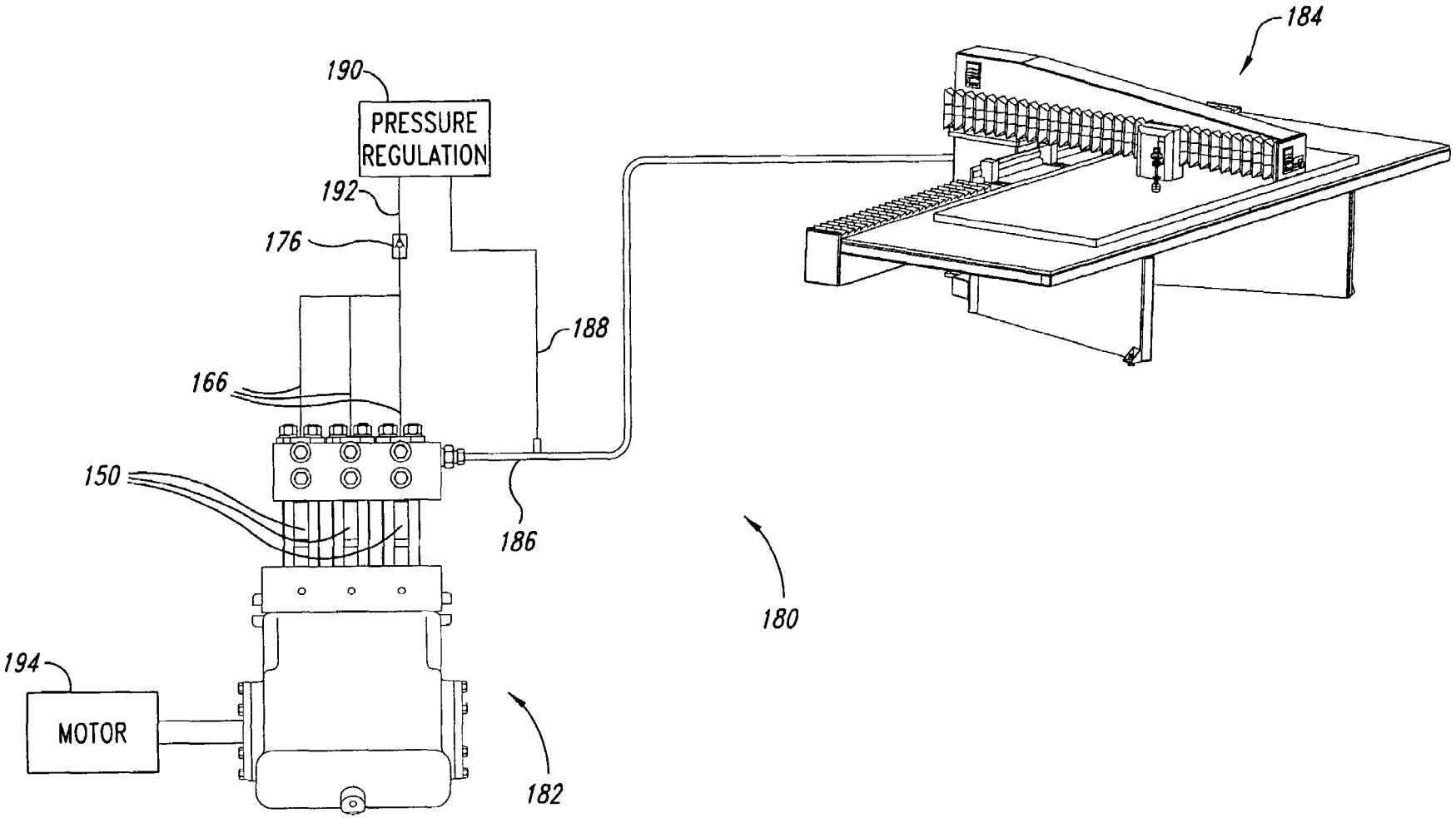
FIG. 6 is a schematic representation of a system according to an embodiment of the invention.

FIG. 6 shows a schematic representation of a typical system 180 according to an embodiment of the invention. The system includes a pump 182, having three cylinder heads 150. A high pressure output line 186 carries pressurized fluid to a tool 184. While FIG. 6 shows a water jet cutting tool, the tool 184 may be any device or process which uses pressurized fluid from the pump 182, such as surface cleaning equipment, isostatic pressurization equipment, etc. Additionally, more than a single tool may be operated from the output of a single pump 182. The pump 182 is driven by a power source 194. The power source may be an internal combustion or electric motor, as shown in FIG. 6, or it may be some other source of power, such as a hydraulic pump or the like.

In accordance with one embodiment of the invention, pressurized fluid from the pump output is provided to the load chambers of the pump cylinders. For example, a high pressure tap 188 provides pressurized fluid from the high pressure output 186 of the pump 182 to a pressure regulation module 190, which provides fluid pressurized at a selected pressure to a regulated pressure output 192, which is supplied to a load chamber inlet 166 of each of the pump heads 150, via a check valve 176. The pressure provided at the regulated pressure output 192 is selected to be sufficient to appropriately pressurize a load chamber in each of the respective cylinders 150, as previously described.

Alternatively, the load chambers of the respective cylinders 150 may be configured to operate at the same pressure as that supplied at the high pressure output 186, in which case the high pressure tap 188 supplies pressurized fluid directly to the load chamber inlets 166 via check valve 176, without additional pressure regulation.

Figure 7:
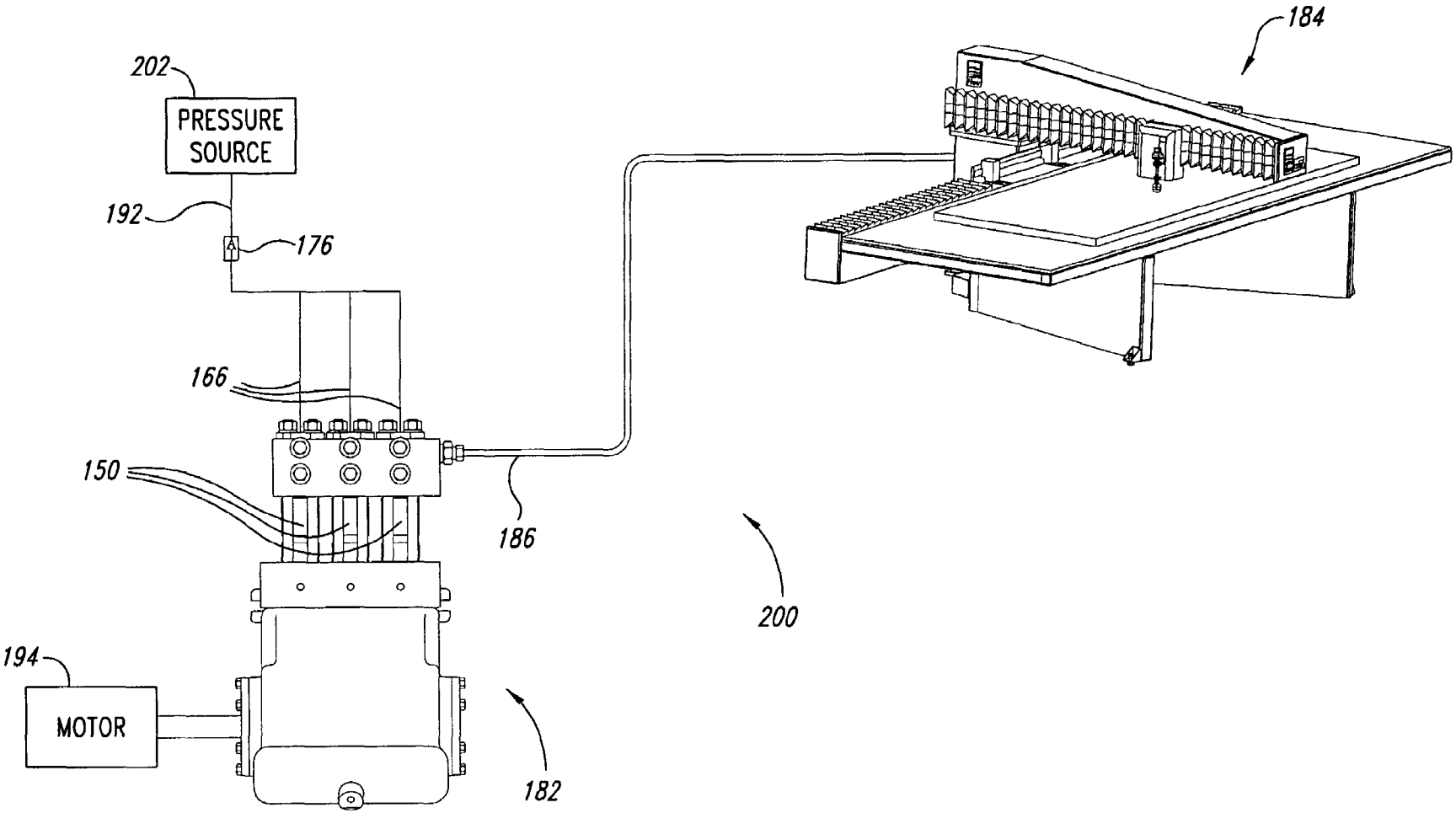
FIG. 7 is a schematic representation of a system according to another embodiment of the invention.

FIG. 7 shows a schematic representation of a system 200, according to an alternative embodiment, in which pressure to the load chambers of the respective cylinders 150 is provided by a pressure source 202, independent of the output provided by the pump 182. According to this embodiment, the pressure source 202 may be a fluid pressure source such as a hydraulic pump or a pneumatic compressor. In either case, the pressure source 202 is configured to provide hydraulic or gas pressure at a selected level to the load chamber inlet 166 of the respective pump heads 150, via the regulated pressure output 192 and the respective check valves 176. This embodiment may be most appropriate in those cases where the load chambers of the respective pump heads 150 are configured to operate at a significantly lower pressure than is provided at the high pressure output 186, and where the cost or complexity of regulating the pressure of fluid from the high pressure output 186 is deemed greater than that of providing an independent pressure source that produces a lower pressure output. It will be understood, however, that use of such an arrangement is not limited to these circumstances.

Figure 8:
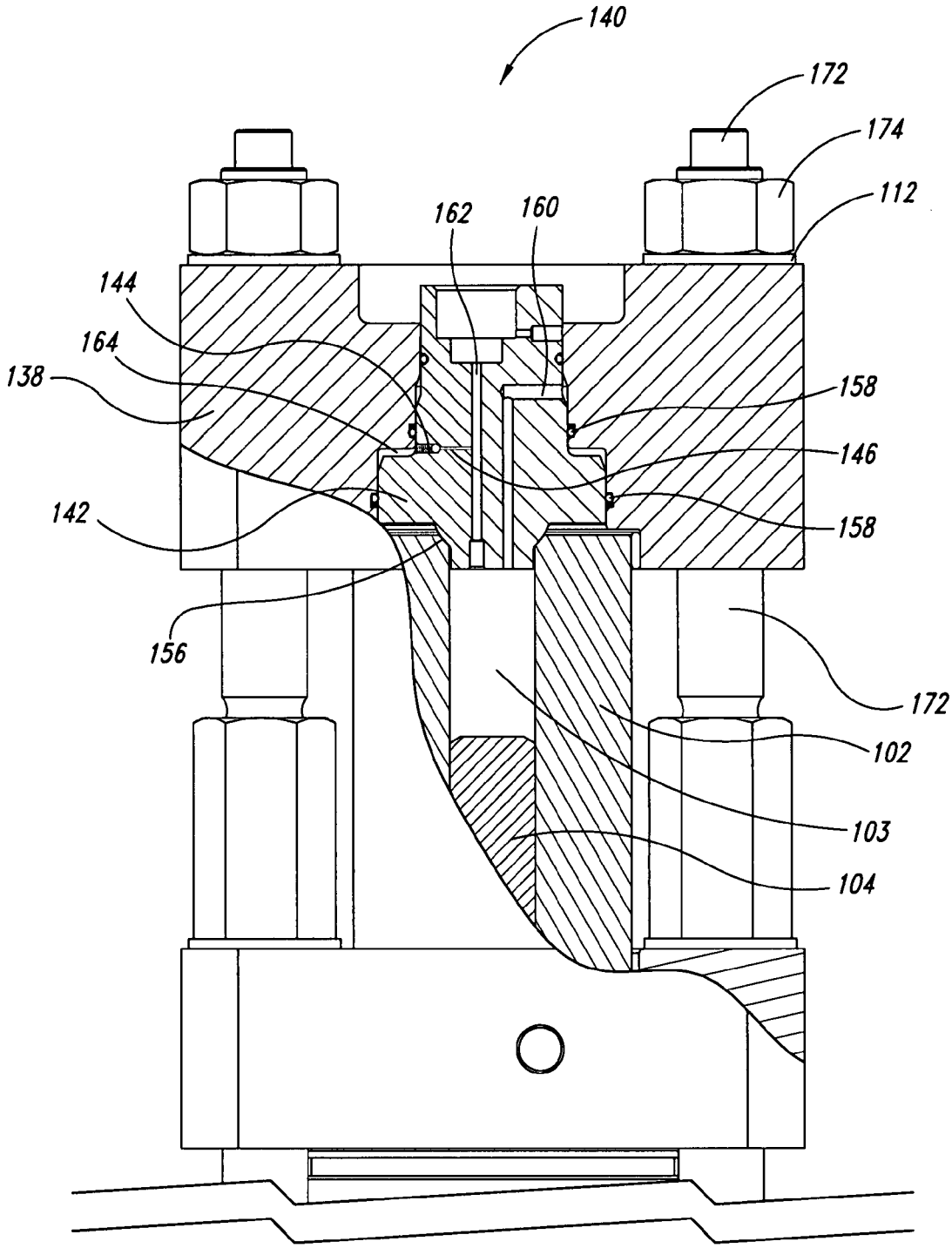
FIG. 8 is a cut-away view of a pump head according to an additional embodiment of the invention.

FIG. 8 illustrates a pump head 140 according to an additional embodiment of the invention. The pump head 140 includes an end cap 138, a valve body 142, a load chamber inlet 146, and a check valve 144. According to this embodiment of the invention, the load chamber inlet 146 supplies pressurized fluid to the load chamber 164 from the cylinder outlet 162, via the check valve 144. This embodiment of the invention provides a means for pressurizing the load chamber without the need for external conduits, check valves, or other external hardware. The load chamber 164 of FIG. 6 may be configured to operate at the operating pressure of the pump head 140. Alternatively, the check valve 144 may be configured to reduce the pressure provided at the outlet 162, such that the load chamber 164 is pressurized at a lower selected pressure, or at a selected ratio of the pressure at the outlet 162.

Figure 9:
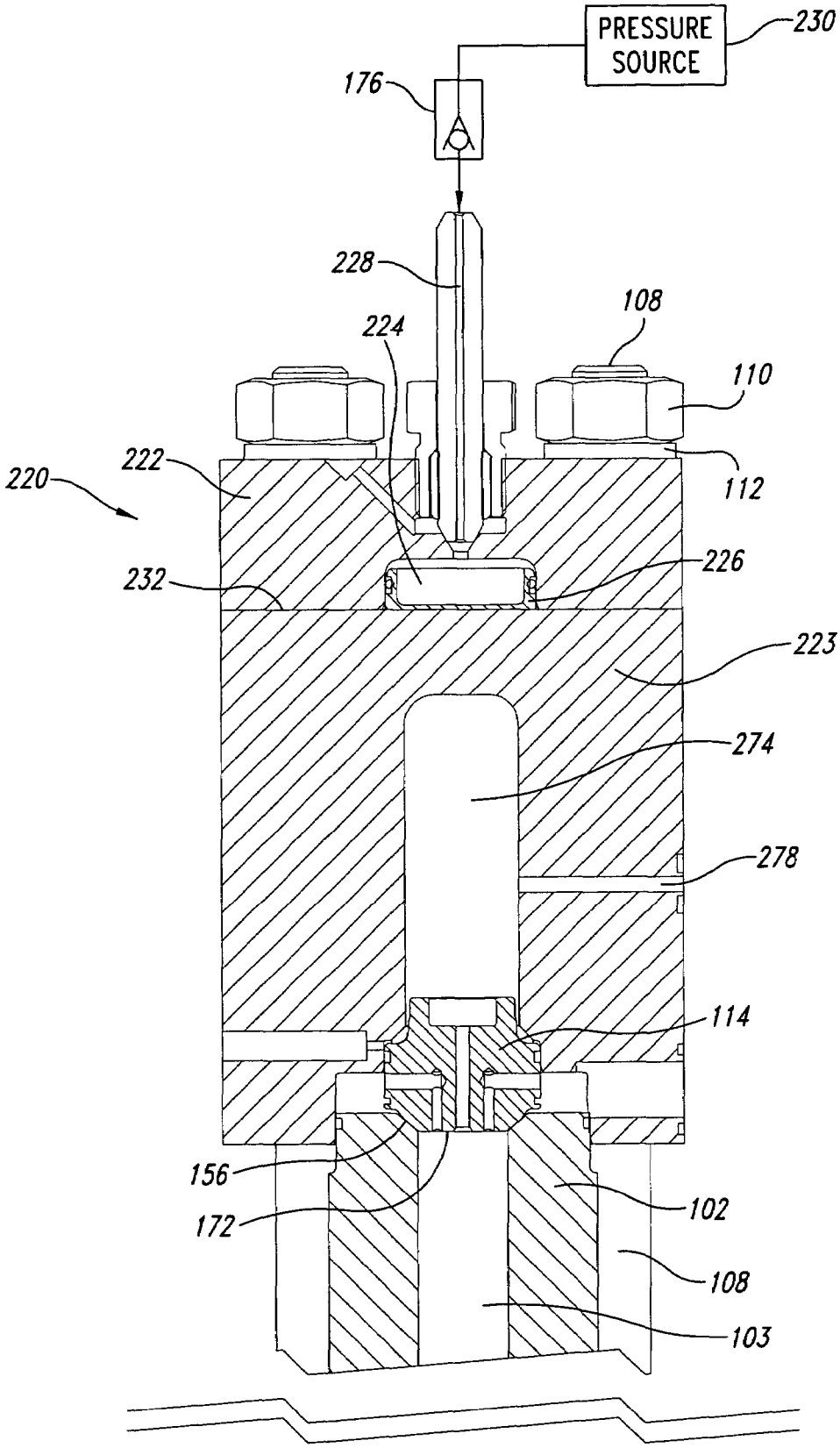
FIG. 9 is a cut-away view of a pump head according to another embodiment of the invention.

FIG. 9 illustrates a pump head 220 according to an additional embodiment of the invention. In addition to features previously described, the pump head 220 includes an outlet chamber 274 configured to receive pressurized fluid from the cylinder 102, an outlet passage 278, a pressure loading cap 222, and a load chamber 224 formed therein. A pressure transmitting member 226 is positioned within the load chamber 224, and a pressure input port 228 is provided. A pressure source 230, external to, and independent of pressure from the pump, provides pressure to the load chamber 224 via a check valve 176, and the pressure input port 228. Prior to operation of the pump 220, the load chamber 224 is pressurized by the pressure source 230. The pressure transmitting member 226 transmits the force in the load chamber 224 to an upper surface 232 of the end cap 223, which force loads the tie rods 108, and biases the static seal 156. The surface area of the pressure transmitting member 226, where the member bears against the upper surface 232 of the end cap 106, is selected to be greater than the surface area of the bottom surface 172 of the valve body. Accordingly, as previously described, the pressure required within the load chamber 224 is correspondingly less than the pressure produced within the cylinder 102. Thus, seals, linkages, and conduits, between the pressure source 230 and the load chamber 224, may be correspondingly less robust than otherwise required, and accordingly less expensive to produce and maintain.

By using the independent pressure source 230, the load chamber 224 may be pressurized to a selected pressure, lower than the pressure at the output of the pump, without the difficulty and expense of regulating the output pressure of the pump from an extremely high value to a relatively low pressure.

Figure 10:
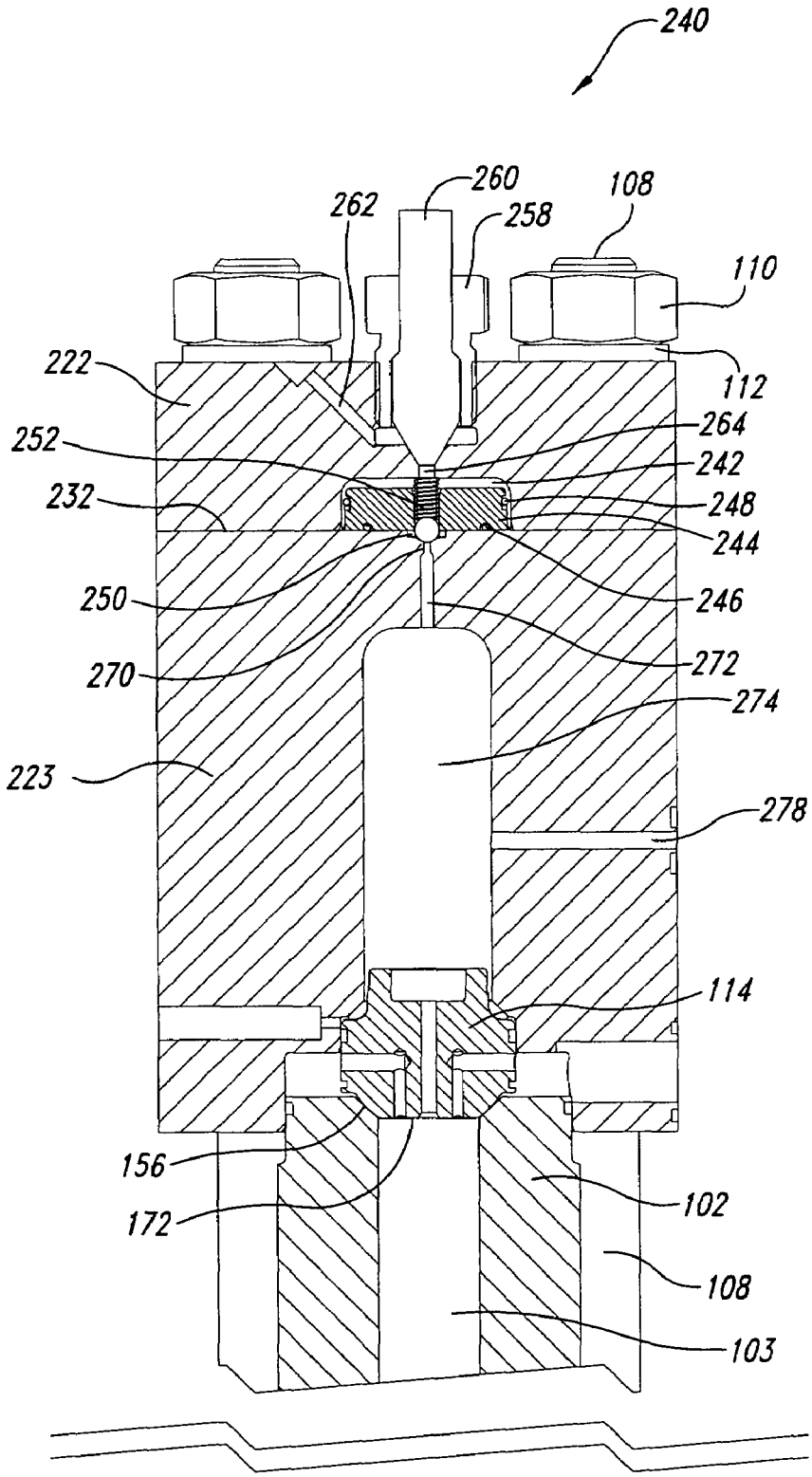
FIG. 10 is a cut-away view of a pump head according to another embodiment of the invention.

FIG. 10 illustrates an additional embodiment of the invention. An internal channel 272 couples the output chamber 274 to the load chamber 242 via a check valve 250. The load chamber 242 is pressurized directly from the output of the pump 240 via the internal channel 272, without the use of external plumbing or conduits. Pressure from the pump 240 passes through the check valve 250 into the load chamber 242, pressurizing the load chamber to a pressure approximately equal to the pressure at the output of the pump. The pressure transmitting member 244 is biased downward against an upper surface 232 of the end cap 223 to load the tie rods 108, as described in previous embodiments. The pressure transmitting member 244 includes seals 246, 248 and a biasing spring 252 to maintain force against the check valve 250.

According to another embodiment of the invention, the check valve 250 is configured to regulate the pressure provided by the pump to a selected pressure or ratio of the pump pressure, such that the load chamber 242 is pressurized at a lower pressure than that provided by the pump. For example, as shown in FIG. 10, an aperture 270 may be provided. The diameter of the aperture 270, in combination with the selected tension of the spring 252 provides means to limit the pressure within the load chamber 242, thus permitting operation of the load chamber at lower pressures than those provided in the output chamber 274 of the pump 240.

The presence of the check valve 250 maintains pressure within the load chamber 242 during periods while the pump 240 is not in operation. Accordingly, the tie rods 108 remain loaded, and thus are not subjected to stresses created by repeated loading and unloading as described previously with respect to conventional systems.

A pressure relief member 260 is provided to release the pressure Within the load chamber 242 for servicing. The pressure relief member 260 is held in place by a retaining member 258 which is threaded into an aperture in the pressure loading cap 222. The pressure relief member 260 is biased against an opening of a pressure relief passage 264 by the retaining member 258. When the retaining member 258 is loosened within the aperture, the pressure relief member 260 backs away from the opening of the pressure relief passage 264, permitting pressure within the load chamber 242 to pass through the passage 264 and through the pressure relief vent 262, releasing the pressure within the load chamber 242.

According to alternate embodiments of the invention, the pressure transmitting members 226 of FIG. 9 or 244 of FIG. 10, may be formed as an integral part of the end cap 223.

Figure 11:
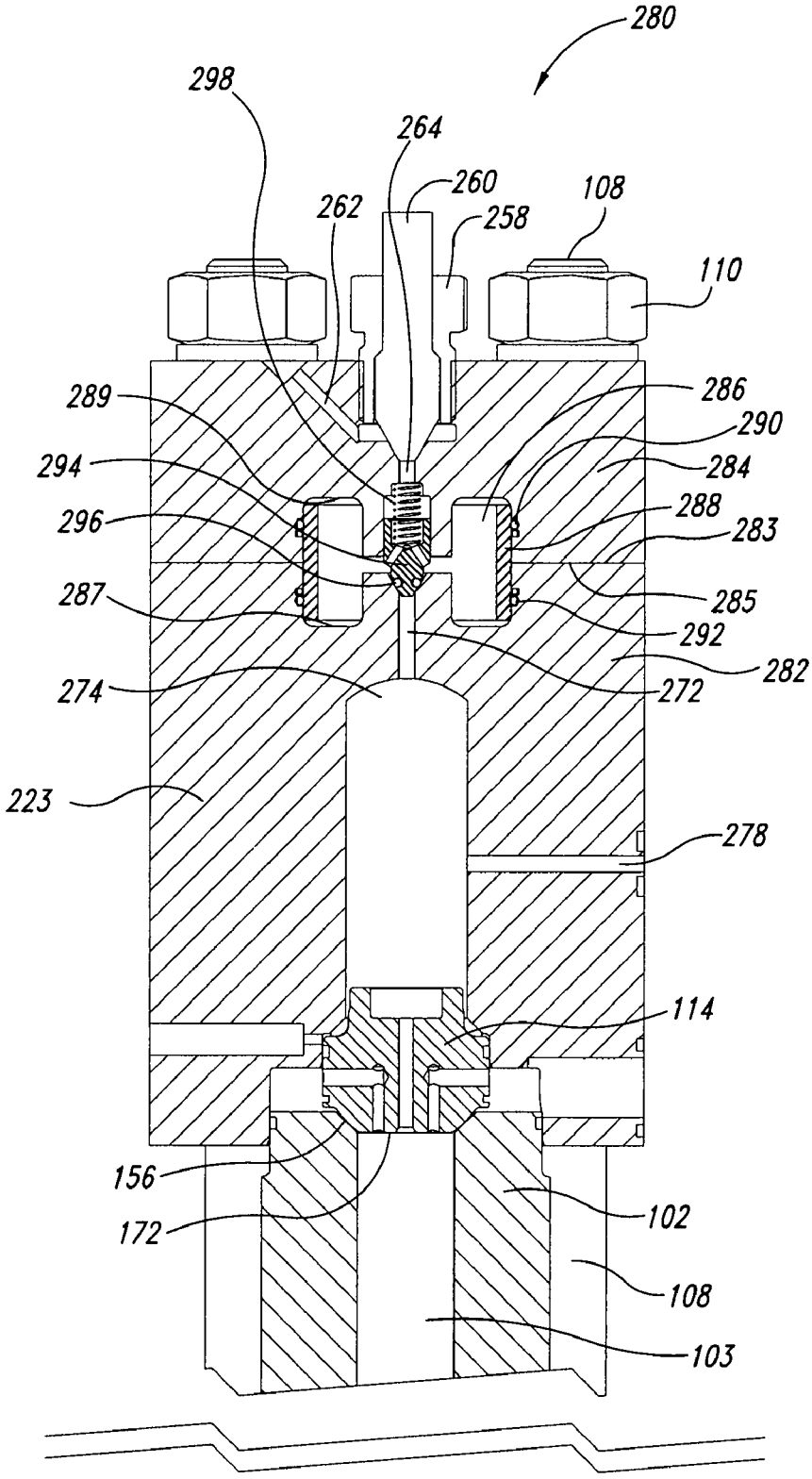
FIG. 11 is a cut-away view of a pump head according to another embodiment of the invention.

FIG. 11 shows an additional embodiment of the invention. According to the embodiment of FIG. 11, a load chamber 286 is formed by the joining of cavities formed in respective faces 283, 285 of the end cap 282 and the pressure loading cap 284. The load chamber 286 has an annular or somewhat toroidal shape. An annular sealing member 288 is positioned within the load chamber 286, and fits snuggly against an outer wall thereof. The sealing member 288 provides an outer surface against which upper and lower seals 290, 292 bear to provide a secure seal for the load chamber 286. The annular sealing member 288 does not transmit any force in a direction parallel to an axis of the bore 103, but rather serves to provide a reliable sealing surface. The load chamber 286 is provided with a check valve 294 configured to admit pressure from the internal channel 272, as described with reference to the embodiment of FIG. 10. The check valve 294 includes a check valve seal 296 and a check valve spring 298. The load chamber 286 also includes a pressure relief passage 264, also as described with reference to the embodiment of FIG. 10.

Pressure from the pump output chamber 274 is transmitted via the internal channel 272 and the check valve 294 to the load chamber 286, where the check valve serves to hold the pressure within the load chamber. Pressure within the load chamber, acting upon the upper and lower surfaces 289, 287 of the load chamber loads the tie rods as described with reference to previous embodiments of the invention.

It will be recognized that the load chamber 286 of FIG. 11 may also be configured to be pressurized from an external pressure source, such as that illustrated with reference to the embodiment of FIG. 9, in which case the internal channel 272 is not required. Additionally, in such an embodiment, the check valve 294 would be configured to regulate incoming pressure from the pressure relief passage 264. Alternatively, the check valve may be positioned outside the pressure loading cap.

While the invention has been described with reference to high pressure fluid pumps and systems, it will be recognized that the principles of the invention may be applied to other devices and systems having a pressurized enclosure. While the present invention is particularly advantageous when employed in ultrahigh-pressure environments, systems operating at lower pressures may advantageously employ the principles of the invention.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A pressure enclosure, comprising:

a pressure body having an opening;

a first member coupled to the pressure body in a position over the opening;

a second member positioned between the pressure body and the first member and covering the opening; and a load chamber defined by a space between the first and second members, configured such that an operating pressure in the load chamber acting on respective surfaces of the first and second members biases the second member against the pressure body over the opening, the load chamber further configured to remain pressurized independent of operation of the enclosure.

2. The pressure enclosure of claim 1 wherein the second member comprises inlet and outlet check valves configured to regulate passage, through the pressure body, of a fluid medium to be pressurized.

3. The pressure enclosure of claim 1 wherein the load chamber is in fluid communication with a source of pressure.

4. The pressure enclosure of claim 3 wherein the source of pressure is external to the pressure body.

5. The pressure enclosure of claim 4 wherein the source of pressure is independent of pressure from the pressure body.

6. The pressure enclosure of claim 5 wherein the load chamber is in fluid communication with the pressure body.

7. The pressure enclosure of claim 1 wherein the load chamber is configured such that a pressure in the load chamber of less than around 75% of a pressure in the pressure body is sufficient to bias the second member against the pressure body to seal the opening.

8. The pressure enclosure of claim 1 further comprising a check valve configured to retain pressure in the load chamber at the operating pressure independent of operation of the enclosure.

9. The pressure enclosure of claim 8, wherein the check valve is internal to the pressure enclosure.

10. The pressure enclosure of claim 8, wherein the check valve is configured to pass a selected proportion of the pressure from the pressure body into the load chamber.

11. A pump, comprising:

a cylinder having a bore in which a medium can be pressurized;

a valve body positioned across a first end of the cylinder;

an end cap coupled to the cylinder and positioned over the valve body such that the valve body is held in position against the cylinder;

a load chamber defined by a space between the valve body and the end cap, the valve body within the load chamber having a surface area greater than a transverse cross sectional area of the bore of the cylinder, the load chamber configured such that a pressure in the load chamber biases the valve body against the cylinder and forms a static seal therebetween; and;

a check valve arranged to admit pressurized fluid into the load chamber and maintain an operating pressure in the load chamber independent of pressure at an output of the pump.

12. The pump of claim 11 wherein the surface area of the valve body within the load chamber is at least around 130% of the transverse cross sectional area of the bore of the cylinder.

13. The pump of claim 11 wherein the load chamber is in fluid communication with a source of pressure.

14. The pump of claim 13, further comprising a pressure regulation device between the source of pressure and the load chamber.

15. The pump of claim 11 wherein the load chamber is in fluid communication with the cylinder.

16. The pump of claim 15, wherin the check valve is positioned within the pump, and the load chamber is in fluid communication with the cylinder via the check valve.

17. A system, comprising:

a pump having a pressure output, and a load chamber defined by a space between first and second elements of the pump and configured to bias the second element of the pump against a cylinder of the pump utilizing an operating pressure lower than about 75% of a pressure at the pressure output;

means for pressurizing the load chamber;

a check valve arranged to maintain the operating pressure in the load chamber during operation of the pump and while the pump is not in operation;

a power source coupled to the pump; and a tool having an input coupled to the pressure output.

18. The system of claim 17, further comprising means for regulating the pressurizing means.

19. The system of claim 17 wherein the pressurizing means comprises a pressure source external to the pump and having an output coupled to the load chamber.

20. A pump, comprising:

a first member having a cylindrical bore;

a second member positioned across a first end of the bore;

a static seal positioned between the first and second members and configured to prevent passage of fluid therebetween;

a third member positioned opposite the first member, relative to the second member;

a load chamber positioned between the second and third members and configured to exert a separating bias between the second and third members, thereby biasing the second member against the static seal;

a passage for transmitting pressurized fluid from an output of the bore to the load chamber; and a check valve in the passage between the load chamber and the bore and internal to the pump, configured to trap pressurized fluid within the load chamber and maintain a pressure established in the load chamber independent of operation of the pump.

21. The pump of claim 20, further comprising a pressure transmitting member positioned within the load chamber and configured to apply biasing force on the second member in response to pressure in the load chamber.

22. pump of claim 21 wherein the check valve is configured to admit fluid to the load chamber at a selected ratio of a pressure of fluid in the bore.

23. A pump, comprising:

a cylinder in which a medium may be pressurized;

a valve body positioned across a first end of the cylinder;

an end cap coupled to the cylinder and positioned over the valve body such that the valve body is held in position against the cylinder;

an outlet chamber positioned between the end cap and the valve body to collect pressurized fluid from the cylinder;

a discharge line coupled to the outlet chamber and configured to transmit pressurized fluid to a region external to the pump;

a load chamber within the end cap;

a passageway, internal to the pump, extending between the outlet chamber and the load chamber; and a check valve provided in the passageway and configured to maintain a pressure established in the load chamber independent of operation of the pump.

24. A pump, comprising:

a cylinder;

a valve body positioned across a first end of the cylinder;

a static seal positioned between the valve body and the cylinder and configured to prevent passage of fluid therebetween;

an end cap positioned opposite the cylinder, relative to the valve body;

a load chamber positioned between the end cap and the valve body and configured to exert a separating bias between the end cap and valve body, thereby biasing the valve body against the static seal;

a passage for transmitting pressurized fluid from an output of the cylinder to a region outside the pump; and a pressure source external to the pump and independent of pressure from the cylinder, configured to pressurize the load chamber to a selected operating pressure.

25. A pump, comprising:

a first member having a cylindrical bore;

a second member coupled to the first member over an end of the bore, the second member including first and second bodies, each having a planar face, the planar faces of the first and second bodies being positioned adjacent to each other;

a valve body positioned between the first member and second members;

a static seal between the first member and the valve body configured to prevent leakage of pressurized fluid from the cylindrical bore;

a load chamber comprising first and second cavities formed in the planar faces of the first and second bodies, respectively, the load chamber configured such that an operating pressure in the load chamber biases the first body away from the first member and the second body toward the first member, thereby exerting a compressing bias on the static seal;

an annular sealing member positioned within the load chamber and configured to provide a sealing surface for load chamber seals without transmitting biasing force in an axis parallel to an axis of the cylindrical bore; and a check valve arranged to maintain the selected operating pressure in the load chamber while the pump is not in operation.

26. The pump of claim 25, further comprising a pressure transmitting passage passing through a portion of the second member and configured to enable fluid communication between the cylindrical bore and the load chamber.

27. The pump of claim 26, further comprising a check valve in the pressure transmitting passage, configured to admit pressure from the cylindrical bore to the load chamber, and to hold pressure within the load chamber.

28. The pump of claim 25, further comprising a pressure transmitting passage passing through a portion of the second member between a pressure source external to the pump and the load chamber.

29. The pump of claim 25, further comprising:

an upper load chamber seal positioned between a wall of the first cavity and the annular sealing member; and a lower load chamber seal positioned between a wall of the second cavity and the annular sealing member.

30. The pump of claim 25, further comprising a channel extending in the second body and configured to place the check valve in fluid communication with the cylindrical bore via the valve body.

31. The pump of claim 25, further comprising a channel in fluid communication with the load chamber, extending in the first body from outside of the pump, and wherein the load chamber is configured to be pressurized via the channel.

32. The pressure enclosure of claim 1, further comprising a valve body positioned between the pressure body and the second member.

33. The pump of claim 24 further comprising a check valve arranged to maintain the selected operating pressure in the load chamber while the pump is not in operation.

34. A pump, comprising:

a cylinder having a bore in which a medium can be pressurized;

a valve body positioned over a first end of the cylinder;

an end cap coupled to the cylinder and positioned over the valve body such that the valve body is held in position against the cylinder by the end cap; and an annular shaped load chamber encircling a portion of the valve body and defined by a space between the valve body and the end cap, the load chamber being configured such that a pressure in the load chamber biases the valve body against the cylinder to form a static seal between the cylinder and the valve body.

35. The pump of claim 24 wherein the end cap comprises an aperture in which the valve body is positioned, a portion of the valve body being accessible from a side of the end cap opposite the cylinder.

36. The pump of claim 24 wherein an outlet port of the valve body is positioned so as to be accessible from a side of the end cap opposite the cylinder.

* * * * *